US008465361B2

(12) United States Patent
Ellis

(10) Patent No.: US 8,465,361 B2
(45) **Date of Patent: *Jun. 18, 2013**

(54) GAMING APPARATUS AND SYSTEMS

(75) Inventor: Benjamin James Ellis, New South Wales (AU)

(73) Assignee: Desert IP Holdings B.V., Curacao (NL)

( * ) Notice: Subject to any disclaimer, the term of this patent is extended or adjusted under 35 U.S.C. 154(b) by 987 days.

This patent is subject to a terminal disclaimer.

(21) Appl. No.: 11/406,468

(22) Filed: Apr. 17, 2006

(65) Prior Publication Data

US 2006/0183530 A1 Aug. 17, 2006
US 2013/0116027 A9 May 9, 2013

(51) Int. Cl.
*A63F 9/24* (2006.01)

(52) U.S. Cl.
USPC ..... 463/25; 463/16; 463/17; 463/18; 463/19; 463/20; 463/23; 463/43

(58) Field of Classification Search
USPC ..... 463/16–20, 21–25, 41–43
See application file for complete search history.

(56) References Cited

U.S. PATENT DOCUMENTS 4,669,731 A 6/1987 Clarke
5,046,735 A 9/1991 Hamano et al.
5,178,390 A 1/1993 Okada
5,630,753 A 5/1997 Fuchs
5,695,402 A 12/1997 Stupak
5,941,773 A 8/1999 Harlick
6,126,542 A * 10/2000 Fier ..... 463/16
6,203,430 B1 3/2001 Walker et al.
6,244,958 B1 6/2001 Acres
6,270,409 B1 * 8/2001 Shuster ..... 463/20
6,375,567 B1 4/2002 Acres
6,758,749 B2 7/2004 Krintzman
6,899,625 B2 5/2005 Luciano, Jr. et al.

(Continued)

FOREIGN PATENT DOCUMENTS

AU 633469 A1 1/1993
AU 200124797 3/2001

(Continued)

OTHER PUBLICATIONS

WIPO, Australian International Search Authority, International Search Report and Written Opinion mailed Dec. 22, 2004 in International Patent Application No. PCT/AU2004/001402, 5 pages.

(Continued)

*Primary Examiner* — Sunit Pandya
(74) *Attorney, Agent, or Firm* — Henricks, Slavin & Holmes, LLP

(57) ABSTRACT

Gaming apparatus, e.g. an Electronic Gaming Machine (EGM) (1), includes a controller (2) for implementing e.g. a slot-machine game, a poker game or the like. The EGM (1) displays a gaming image on a display (5), e.g. virtual symbol reels or card hands, and receives player instructions via an input (6) or the like, e.g. to spin the reels or manage the cards. The EGM (1) includes a guarantee feature in which an event is guaranteed to trigger if a monitored event (e.g. of the same type as the guaranteed event) does not occur within a set amount of gameplay. A guarantee indicator (9), e.g. a numerical countdown or gauge, indicates the remaining amount of gameplay required before the guarantee feature triggers. The monitored and/or guaranteed event may be a win event or a feature event, e.g. the triggering of a bonus round, free game or the like.

37 Claims, 2 Drawing Sheets

U.S. PATENT DOCUMENTS

| | | | | |
|---|---|---|---|---|
| 6,916,243 | B2 | 7/2005 | Yoshida | |
| 7,416,485 | B2 | 8/2008 | Walker et al. | |
| 2002/0187836 | A1* | 12/2002 | Meyer | 463/42 |
| 2003/0013516 | A1 | 1/2003 | Walker et al. | |
| 2003/0064809 | A1 | 4/2003 | Okada | |
| 2003/0069073 | A1 | 4/2003 | Okada | |
| 2004/0002377 | A1* | 1/2004 | Staw et al. | 463/25 |
| 2004/0014522 | A1* | 1/2004 | Walker et al. | 463/25 |

FOREIGN PATENT DOCUMENTS

| | | | |
|---|---|---|---|
| AU | 200155960 | | 7/2001 |
| AU | 2002301274 | A1 | 6/2003 |
| AU | 2002301340 | A1 | 6/2003 |
| DE | 3820865 | A1 | 12/1989 |
| EP | 0 189 256 | A2 | 7/1986 |
| GB | 2117155 | A | 5/1983 |
| GB | 2112984 | A | 7/1983 |
| GB | 2148036 | A | 5/1985 |
| WO | WO 94/01840 | | 1/1994 |

OTHER PUBLICATIONS

WIPO, Australian International Preliminary Examining Authority, International Preliminary Report on Patentability mailed Dec. 6, 2005 in International Patent Application No. PCT/AU2004/001402, 3 pages.

*Australia/New Zealand Gaming Machine National Standard*, Revision 5, Jan. 4, 2002, paragraphs 3.9.33-39, 3 pages.

Robert N. Geddes et al., Extract of Book "*Owner's Pictorial Guide for the Care and Understanding of the Mills Bell Slot Machine*," Jan. 2010, Mead Publishing Company, North Las Vegas, Nevada, U.S.A. ,21 pp.

*Australian/New Zealand Gaming Machine National Standard Queensland Appendix*, Version 6.0.1, Apr. 28, 2003, The State of Queensland, Queensland Office of Gaming Regulation, 15 pages.

*Australian/New Zealand Gaming Machine National Standards*, Revision 6.0, Dec. 6, 2002, 127 pages.

*Amazon Jewel*, Brochure, International Game Technology, Mar. 2000, New South Wales, Victoria, and Queensland, Australia, 1 page.

*Blue Moon*, Brochure, International Game Technology, Mar. 2000, New South Wales, Victoria, and Queensland, Australia, 1 page.

*Hocus Pocus*, Brochure, International Game Technology, Mar. 2000, New South Wales, Victoria, and Queensland, Australia, 1 page.

*Australian/New Zealand Gaming Machine National Standards*, Revision 1.2, Jul. 15, 1998, 118 pages.

*Minutes of AGMMA*, Australian Gaming Machine Manufacturers Association Ltd., Nov. 6, 1997, Rosebery, Australia, 3 pages.

*Return of the Samurai*, Brochure, Feb. 1997 Aristocrat Leisure Industries, Rosebery, New South Wales, Australia, 2 pages.

*Letter of Invitation*, Victorian Gaming Commission, Department of Arts, Sport and Tourism, Apr. 5, 1994, Mascot, New South Wales, Australia, 2 pages.

*Dolphin Treasure*, Brochure, Feb. 1994, Aristocrat Leisure Industries, Rosebery, Australia, 2 pages.

*Scatter Rug Specification*, Liquor Administration Board, Jul. 28, 1987, Sydney, New South Wales, Australia, 4 pages.

*Final Approval of "Scatter Rug" and "Magnificent 5" Poker Machine Models*, Liquor Administration Board, 1987, Sydney, New South Wales, Australia, 14 pages.

*Money Back Specifications and Approval*, "Poker Machine Specifications," 1984-1985, Secretary and Comptroller of Accounts, The Treasury, 22 pages.

Richard M. Bueschel, Extract of Book "An Illustrated Price Guide to the 100 Most Collectible Slot Machines," The Coin Slot, 1978, 3 pages.

*Cashcade*, Brochure, 4 pages.

*Dolphin Treasure*, Calculations, 22 pages.

*Life's A Beach*, Brochure, Konami, Tasman Series, Australia, 2 pages.

*Mr. Cashman*, Brochure, 2 pages.

* cited by examiner

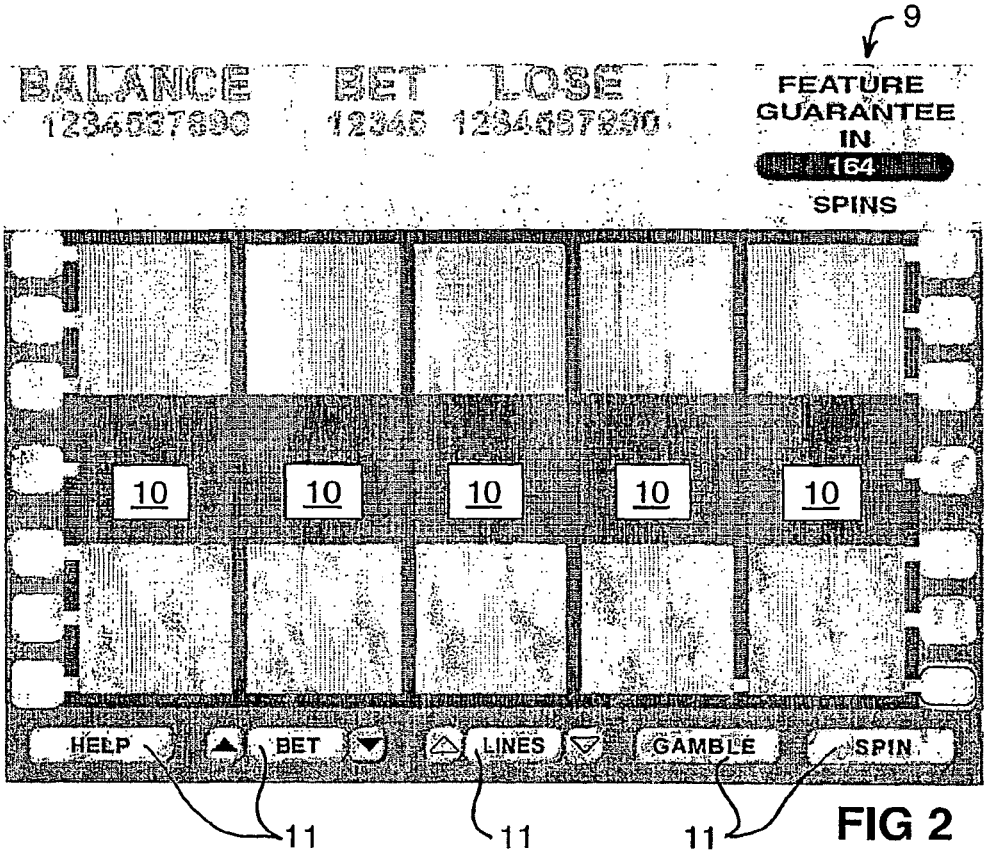
FIG 2
FIG 3
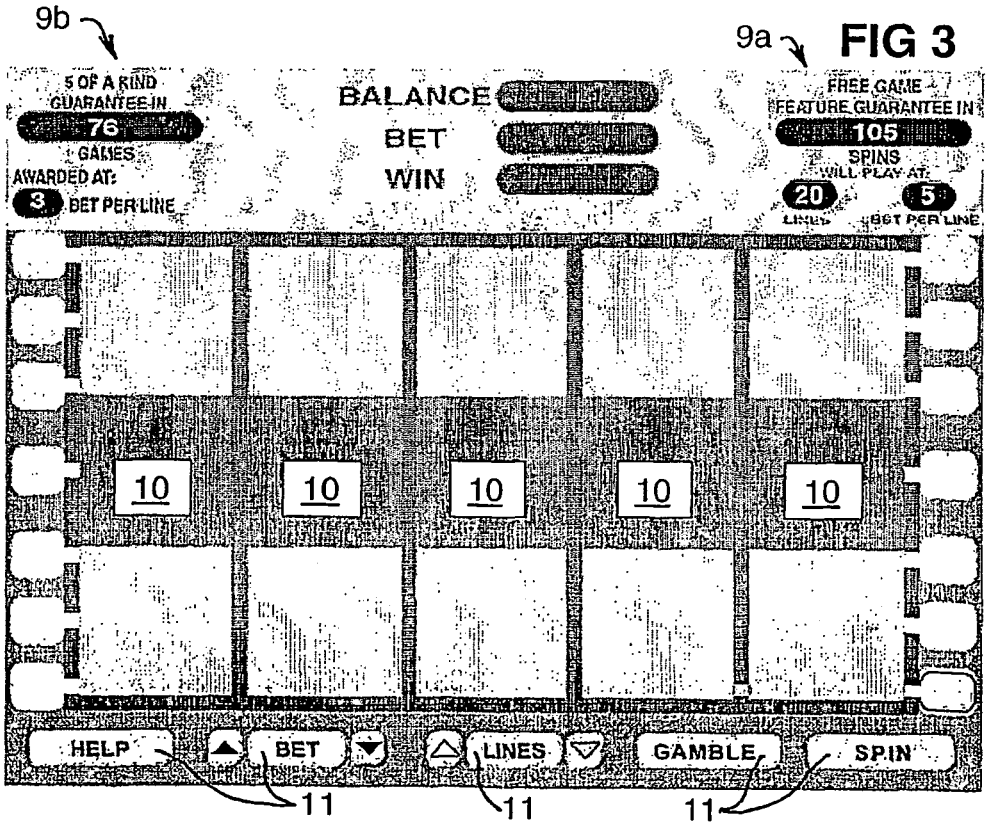

GAMING APPARATUS AND SYSTEMS

CROSS-REFERENCE TO RELATED APPLICATIONS

This is a Continuation of and claims priority from PCT Application No. PCT/AU2004/001402 filed on Oct. 13, 2004 entitled Gaming Apparatus and Systems, which claims priority from Australian Patent Application No. 2003905703, filed on 17 Oct. 2003; the content of both of which are incorporated herein by reference.

FIELD OF THE INVENTION

The present invention relates to gaming apparatus and systems. It relates for example to electronic gaming machines and to networked gaming systems, such as Internet-based gaming systems.

Gaming machines have been a popular form of entertainment for many years. This popularity has been enhanced with the advent of electronic gaming machines and computer-based gaming systems, such as are provided over the Internet.

Many different types of game are payable. They include for example standard slot-machine type games with spinning reels, poker machines, keno, bingo, blackjack, roulette, pachinko and the like.

A user will typically place a bet, press a button or pull a lever to begin a game, and will win or lose based upon the gaming machine's play algorithm and random number generator.

An aim of the present invention is to provide gaming apparatus having novel features for enhancing gameplay interest.

BACKGROUND

Viewed from one aspect, the present invention provides gaming apparatus including: a component for monitoring gameplay; a component for monitoring the occurrence of a game event; and an event guarantee component for guaranteeing that a game event will trigger within a set amount of gameplay, the event guarantee component including: a trigger component for triggering a game event when the set guarantee gameplay amount is reached without the monitored event having been triggered, and an indicator component for indicating the amount of gameplay remaining to be played before a guaranteed game event will trigger.

Gameplay measurement can be based on e.g. the number of games played, e.g. the number of spins of a slot machine or the number of hands of a card game played, or the amount of bets laid, e.g. the amount of credits laid, the amount of lines or hands played, or some other parameter indicative of an amount of gameplay.

A game event may be of any suitable kind. It may be a type of win event or a type of feature event.

A win event may for example relate to a win of a particular amount, e.g. a win over a set amount, or could relate to a win under a particular circumstance, e.g. a flush or the like at poker or a set combination of slot machine reel symbols. It could also relate to a jackpot win, which could be e.g. for a stand-alone or linked jackpot system, and of a fixed or progressive kind.

A feature event could relate to the occurrence of a particularly valuable play element, such as a wild card or wild symbol. It could further relate to a bonus or extra event that provides some added benefit to the player and/or game interest. It could for example be a free play scenario, a respin, a pick'n'win, or a game play that returns higher than usual wins. It may be a "second-screen" type feature, which may involve a play that is extraneous to a main or basic game. The feature event could be e.g. a luck or skills-based feature.

The present invention provides a way of increasing the interest of a game. It provides a guarantee feature that can be of benefit to a gaming machine operator in that it promotes the use of the operator's machines, and can be of benefit to users who can know that an event of benefit to the user will indeed occur within an indicated amount of gameplay.

The monitored event and the guaranteed event are preferably the same type of event, so that a user knows that for example if a "4 of a kind" does not occur normally within a set time, then it will definitely occur at the end of the set amount of gameplay, or for example that a "free game" will definitely occur by a set amount of gameplay and will possibly occur beforehand.

The monitored and guaranteed events do not however have to relate to the same event, and indeed a specific event need not be specified. For example, the monitored event and/or guaranteed event may be one of a number of possible events, so that for example if none of the possible events occurs within a set amount of gameplay, then one of a number of these or other events will be triggered to occur.

The event guarantee indicator may take any suitable form. It may be a numerical display that provides a countdown from an initial gameplay amount, or it may take the form of a gauge, e.g. with a pointer and scale. It may specify the specific event that is guaranteed or the type of event.

The amount of gameplay required for the guarantee to trigger may be determined in any suitable manner. It may for example be a set amount or may be determined randomly (e.g. within a set range), and/or may be varied in accordance with gameplay, e.g. depending on the winnings or bets taken over a preceding period of play.

Preferably, the guarantee gameplay amount will be reset when a monitored event occurs during normal play or when the guaranteed event occurs, and the indicator will e.g. be reset to an initial gameplay amount. When reset, the guaranteed event may take a different form from that of the previous guarantee. This may be determined randomly or in accordance with a preset sequence and/or may vary based on previous gameplay.

Normal triggering of the monitored feature, i.e. before the guarantee gameplay amount has been reached, may occur in any suitable manner. It may for example occur randomly, and/or on the basis of a particular set of circumstances, and/or over an accumulation of plays. It may also occur in relation to a device supplemental to the game itself, e.g. the triggering of a jackpot in a linked jackpot system.

Preferably, the apparatus includes a component for determining the play parameters for the guarantee feature. Thus, when a bonus game or the like is triggered, the play parameters may be e.g. the number of lines or hands played and the amount bet on each line or hand. When a win event is triggered, the play parameters may be the amount paid out or the win type.

The play parameters may be determined based on a user's play history, and may be an average of a user's play parameters over time, e.g. whilst the guarantee gameplay amount was accumulating. It could also be set to a specific value, or be determined randomly (e.g. within a set range). It could also or alternatively be varied based on a user's own bet requirements, e.g. a user may supplement or vary the bet.

The guarantee indicator may display the play parameters that are to be used in the guarantee feature, and these may update as a user plays.

In one preferred embodiment, the gaming system may provide more than one guarantee feature, and may include more than one event guarantee indicator. Thus, one indicator may display the amount of gameplay remaining until one event is guaranteed to trigger, and another indicator may indicate the amount of gameplay remaining until another event is guaranteed to trigger.

More than two guarantee features may also be used. These guarantee features may be reset independently or together.

A guarantee feature indicator may also change the feature that it is monitoring with time, e.g. in view of a particular play circumstance or the like, e.g. in the case of games that may alter possible feature or win events during play.

The present invention may be applied to any suitable type of gaming system or platform. It can apply to stand-alone gaming apparatus, e.g. electronic gaming machines, such as video gaming machines, to gaming machines that are linked together, e.g. via a network such as an intranet, and/or to gaming systems provided through computing or other electronic devices, e.g. personal computers, PDAs, mobile telephones, digital televisions, and the like, e.g. over the Internet or other communications networks.

The present invention may be applied to gaming apparatus that plays any suitable game, e.g. slot-machine type games, poker, keno, blackjack, bingo, roulette, pachinko, or the like.

When part of a network, the guarantee feature of a particular gaming device may be based on gameplay only of that particular device or may be based on the gameplay of other linked devices as well, e.g. all of the devices that are taking part in a particular linked game or a subset of them. The guarantee feature may guarantee an event to an individual device or may guarantee an event to one of a number of the devices.

In networked games, the apparatus may include a central control for conducting games and managing the accounting and the like, and a number of remote terminals/clients that provide user input and display mechanisms. The control of the feature guarantee may be carried out at the central control or at the remote terminals, or may be split between the two. For example the central control may control all features of an indicator on a remote screen, or the central control could set up the initial indicator parameters for a remote screen, and the feature guarantee could then be controlled directly by the remote terminal software without receiving any further direct instruction from the central control.

The present invention extends to central controls/servers and to remote terminals/clients that are configured to carry out the feature guarantee of the present invention.

SUMMARY OF THE INVENTION

Viewed from another aspect, the present invention provides a gaming system including: a component for monitoring gameplay; a component for monitoring the occurrence of a game event; an event guarantee component for triggering a guaranteed game event if the monitored game event has not triggered within a set amount of gameplay; and a guarantee indicator component for providing a guarantee indicator that indicates the amount of gameplay that must occur before the guaranteed event is triggered.

Viewed from another aspect, the present invention provides a method of operating gaming apparatus, the method including the steps of: monitoring gameplay; monitoring the occurrence of a game event; triggering a guaranteed event if the monitored event does not occur within a set amount of gameplay; and indicating the amount of guarantee gameplay remaining before a guaranteed event is triggered.

Viewed from a further aspect, the present invention provides a gaming software product/gaming software including: a component for monitoring gameplay; a component for monitoring the occurrence of a game event; and an event guarantee component for guaranteeing that a game event will trigger within a set amount of gameplay, the event guarantee component including: a trigger component for triggering a game event when the set guarantee gameplay amount is reached without the monitored event having been triggered, and an indicator component for indicating the amount of gameplay remaining to be played before a guaranteed game event will trigger.

Viewed from a still further aspect, the present invention provides gaming apparatus including: a gameplay monitor for monitoring user interactions with the apparatus; an event monitor for monitoring the occurrence of a game event; and a guarantee feature for triggering a gaming event if the monitored event has not occurred within a set amount of gameplay and for indicating to a user the amount of gameplay remaining before the guarantee feature is triggered.

Viewed from another aspect, the present invention provides an electronic game in which a bet is placed, game events occur and wins are returned, and gameplay and game events are monitored, and including a guarantee feature, wherein if a monitored event does not occur within a predetermined amount of gameplay, a guaranteed event is triggered.

Viewed from a still further aspect, the present invention provides gaming apparatus including: means for monitoring gameplay; means for monitoring the occurrence of a game event; and event guarantee means for guaranteeing that a game event will trigger within a set amount of gameplay, the event guarantee means including: a trigger component for triggering a game event when the set guarantee gameplay amount is reached without the monitored event having been triggered, and an indicator means for indicating the amount of gameplay remaining to be played before a guaranteed game event will trigger.

It should be noted that any of the features of any of the aspects mentioned above may be combined with any other features mentioned above, as appropriate.

BRIEF DESCRIPTION OF THE DRAWINGS

Embodiments of the present invention will now be described, by way of example only, with reference to the accompanying drawings. It is to be understood that the particularity of the drawings does not supersede the generality of the preceding description of the invention.

In the drawings:

FIG. 2 is a generic gaming display screen shot including a feature guarantee gauge according to an embodiment of the present invention;

FIG. 3 is a generic gaming display screen shot according to another embodiment of the present invention.

DETAILED DESCRIPTION

Figure 1:
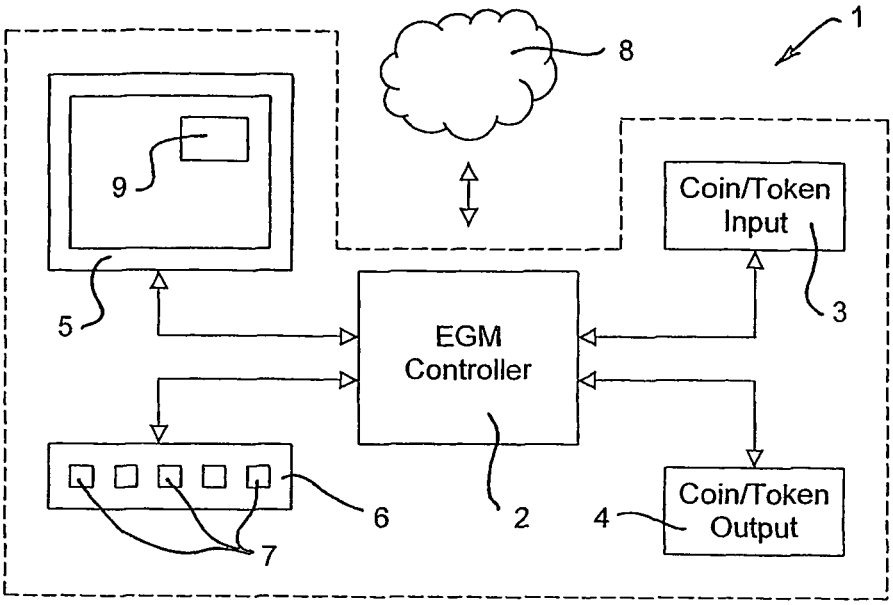
FIG. 1 is a block diagram of gaming apparatus according to one embodiment of the present invention.

Referring to FIG. 1, gaming apparatus, which in this case takes the form of an electronic gaming machine(EGM) 1, includes various standard components, such as a controller 2 for controlling the operation of the EGM 1 and the games run on it, a coin/token/card input 3 for receiving bets, a coin/token/card output 4 for paying out winnings, a display 5 for displaying game screens, and user inputs 6 for allowing user interaction, which may include e.g. buttons 7 and which may e.g. be provided as part of the display 5 in a touch-screen type manner.

The EGM 1 may be a stand-alone machine. It may also be networked with other EGMs and/or a control centre via a suitable communications network 8, such as a LAN and/or WAN, in order to play networked (e.g. intranet or Internet) games, such as a linked jackpot.

In use, the EGM 1 will display an initial gaming screen on the display 5.

A player will insert coins, tokens and/or a payment card into the EGM input 3, and will press a button 7 to initiate play. How matters then proceed will depend on the type of game being played. For example, in a slot machine-type game, the EGM 1 will display virtual reels of symbols, and will spin and stop these reels in various win and lose symbol combinations on a payline in accordance with a stored gaming algorithm and random number generator. Alternatively, in a poker-type game, a player will receive a number of cards with which to play for a winning hand.

The player may interact with the machine via the buttons 7, so as e.g. to spin or hold reels, or to obtain and throw away cards.

Whatever game is played, a common element will be win events, e.g. particular symbol or card combinations, that pay out a prize or jackpot.

Also, in order to increase interest, a game will often include feature events that may or may not relate directly to the game being played, and that generally provide a bonus of some sort. These feature events may include for example one or more free games, a respin (similar to a free game but with one or more reels held), a pick'n'win, the chance to play for higher winnings or the like. They may be e.g. luck or skills based. They may be provided as "second screen" features that display on a new screen, and may be extraneous to the basic game.

Another way of adding gaming interest is to include a wild feature, such as wild symbols or wild cards that can represent more than one type of symbol or card, and so can increase the chances of achieving a winning combination or the like.

These win and feature events can be arranged to occur randomly or under a particular set of circumstances, e.g. under a set symbol or card combination. They may also occur due to an accumulation of circumstances across a number of games, and may occur due to the condition of a device supplemental to the EGM 1 itself, e.g. they may relate to jackpot wins in linked jackpot systems comprising a plurality of EGMs under a central control.

In accordance with one embodiment of the present invention, the EGM 1 includes an event guarantee component, e.g. within the gaming algorithm. This event guarantee component monitors one or more game events to determine whether they are triggered or not, and guarantees that a particular game event, or at least one of a number of possible game events, will trigger within a set amount of gameplay, if the standard conditions for triggering of the monitored game event or events are not met within that period of play.

The EGM 1 generates a guarantee indicator 9 on the display 5 that indicates to a player the guarantee count, i.e. the amount of gameplay remaining before the guaranteed event will be triggered.

The guarantee indicator 9 may be e.g. a numerical countdown, or a virtual gauge or the like, on the display 5.

Gameplay may be measured by for example a measurement of user interaction with the gaming apparatus. For example, it may be based on the number of games played or the amount of bets wagered.

Thus, in accordance with this embodiment, a guarantee feature is provided by which a player or potential player will know the maximum amount of gameplay that can occur before at least one event is triggered, and this amount will decrease as play continues. A player or a potential player will know that even if they do not achieve the standard conditions for a monitored game event, a guaranteed game event will trigger at the end of the guarantee count.

The monitored event and the guaranteed feature event are in one embodiment the same event, so that a player knows that if they do not achieve the event normally, they will achieve it within the guarantee count.

The monitored and guaranteed event need not however be the same event. For example, the EGM could monitor a number of events, and if none occurs normally, could trigger a particular event, e.g. of a set value or type, or could trigger one event from a number of possible guarantee events that could e.g. be chosen at random.

The monitored feature event may be any suitable type of event, e.g. a free game, a free spin, a high payout game, or the appearance of a wild feature or other game advantage. It may be any event that can occur during the course of a game and that is advantageous and/or of interest to a player. It could also be a win event, e.g. of a particular amount or of a particular type.

In one embodiment, the indicator 9 will countdown from an initial number that may represent the number of games to play before an event is guaranteed to trigger or may represent the remaining bet value that must be placed before the guarantee triggers. The initial count value may be a preset amount in accordance with e.g. a look-up table or a sequence of numbers or the like, or may be randomly chosen e.g. using a random number generator operating between some minimum and maximum gameplay values.

If a monitored event occurs before the guarantee count has finished, then the count is reset, e.g. to its initial value, so as to start the count again. Thus, if a player triggers an event prior to the end of the guarantee count, the guarantee count is restarted. The event or events guaranteed may be changed at each reset, e.g. randomly or in a set sequence or depending on gameplay.

FIG. 2 is a generic gaming screen shot showing one way of implementing the event gauge 9.

The screen shot shows a number of virtual gaming reels 10 that are spun to provide symbol combinations in accordance with the rules of the gaming algorithm run by the controller 2. It also shows the display 5 having touch buttons 11.

In the top right-hand corner of the display 5, the screen includes a guarantee indicator 9 in the form of a numerical display, e.g. a countdown from an initial number of spins. The indicator 9 does not specify what event is guaranteed to trigger, except that it is a feature event (rather than a win event), and when the countdown reaches zero, any appropriate feature event may be triggered in accordance with predetermined rules and/or randomly.

The monitored event or events may take any appropriate form, and so the gaming apparatus may determine that one of a number of feature events may be triggered by the guarantee if no win and/or feature events have occurred during the guarantee countdown or if only a win event or feature event of low value or interest where achieved during this period.

The EGM 1 may provide more than one guarantee feature, and more than one guarantee indicator 9 may then be displayed. For example, FIG. 3 shows an embodiment of the present invention in which a pair of guarantee indicators 9*a*, 9*b* are provided.

In the embodiment shown, one guarantee indicator 9*a* relates to a feature event, whilst the other 9*b* relates to a win event, and the monitored event is the same as the guaranteed event. Thus, indicator 9*a* relates to a free game feature, which will definitely occur within 105 spins, if not earlier, whilst indicator 9*b* relates to a "5 of a kind" win, which will definitely occur within 76 games, if not earlier.

It will be noted that indicator 9*a* measures gameplay based on spins, whilst indicator 9*b* measures gameplay based on "games", which in this context, means a payline played. Thus, if three paylines were played on one spin of the reels 10, count 9*a* would countdown by one, whilst countdown 9*b* would countdown by three.

Generally, the guarantees will count down until zero, at which time the appropriate event will trigger. If the particular event guaranteed occurs under normal play conditions, however, the guarantee indicator is reset to its initial value to begin the guarantee period again.

In this regard, both indicators 9*a* and 9*b* could be reset at the same time, e.g. when either of the two monitored events occurs, or each could be reset independently, e.g. when their respective events occur. As mentioned above, it would also be possible for the monitored events to be different from the guaranteed events, so that the guaranteed events will occur if no other events occur in the meantime.

The guarantee indicators 9*a*, 9*b* also display the play parameters under which the guaranteed events will occur. Thus, for the free game of indicator 9*a*, the free game will play using 20 lines at a bet of 5 credits per line, whilst the 5 of a kind will be awarded at 3 credits per line.

The play parameters may be chosen in any desired manner, and may be fixed or may be randomly generated within certain ranges. In a preferred embodiment, the play parameters are determined based on a user play history. Thus, the number of lines played and/or the amounts bet may be averages of the lines played and bets placed over a number of the user's previous games. In this case, the guaranteed play parameters displayed may vary with play.

The averaging of a player's bet history or the like may produce a residual or rounding amount not used in the awarded play parameters. For example, a player may have 104 free credits built up that are split in the play parameters as 5 bets lines of 20 credits each. In this case, the residual 4 credits may be compensated by changing the odds of a higher win or the like in the free game to favour the user, or by crediting the amount to the user.

The credits required for the play parameters are preferably not deducted from a player's stake, i.e. the guaranteed event is a free event. It would however also be possible to deduct the bet amounts from the player's stake, in which case the guaranteed event may pay out at higher odds or the like to give the event a bonus aspect.

Figure 4:
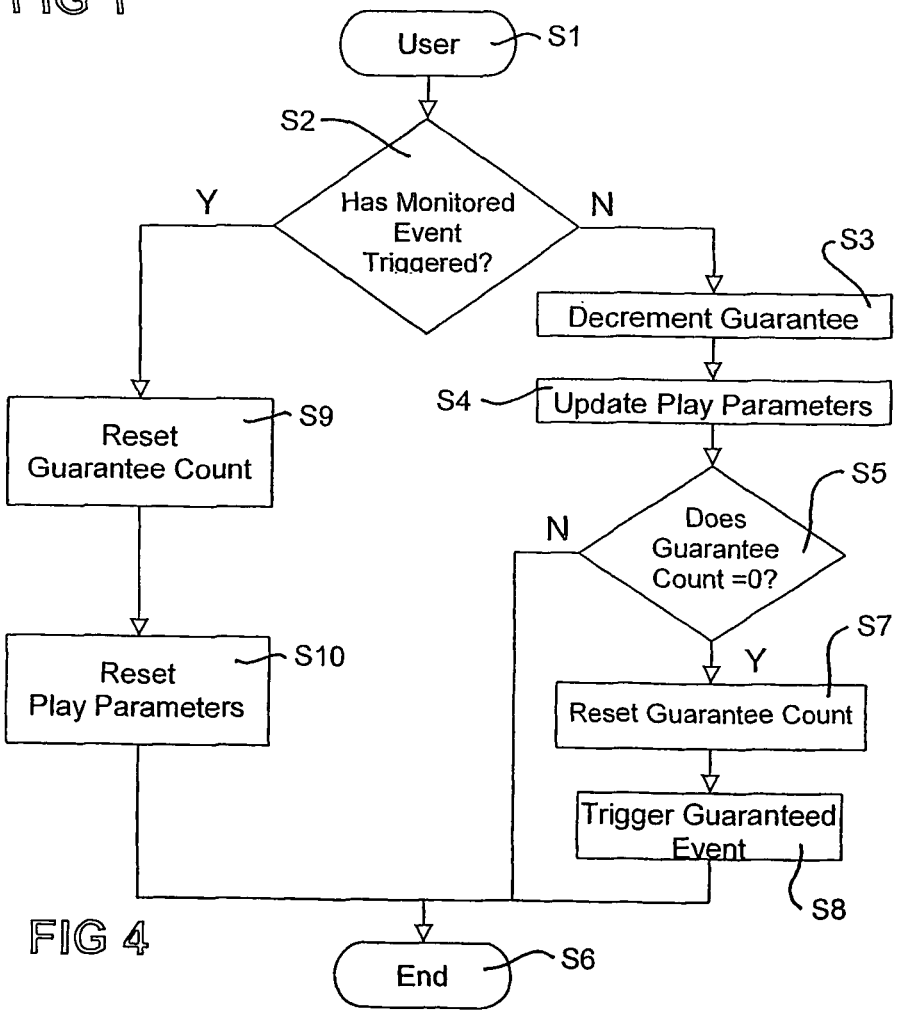
FIG. 4 is a flow diagram of a gaming control process in accordance with an embodiment of the present invention.

FIG. 4 shows an example of a flowchart for the control of the gauge 9 by the controller 2. Thus, in one embodiment, the invention may be put into effect by the controller 2 running software that incorporates a subroutine executing in a manner similar to that shown.

The routine in entered at step S1 when gameplay, e.g. a user play of some sort, occurs, e.g. when a start button is pressed. The controller 2 then determines at step S2 whether the resulting play has triggered the monitored event.

If the answer is "no", control passes to step S3, where the guarantee count is decremented by one, and to step S4, where the play parameters for the guaranteed event are recalculated, e.g. the average of the lines of play and the credits bet are adjusted by the play parameters of the game just played.

The controller then determines at step S5 whether the guarantee count has reached zero. If no, the routine ends at step S6. If yes, the count is reset in step S7 in readiness for a new guarantee period, and the guaranteed event is triggered at step S8 before the routine ends again in step S6.

In step S7, the counter may be reset to the same initial countdown value as before, or could be set to a different value, e.g. based on a random number within a set range.

In step S8, the guaranteed event will begin with the play parameters calculated at step S4.

If the answer at step S2 is "yes", i.e. the guaranteed event has been triggered due to normal play conditions, then the guarantee count is reset in step S9, in a similar manner to step S7, and the play parameters are reset at step S10, e.g. to zero or a set minimum value (which may then be modified depending on the player's subsequent bets). The routine ends in step S6.

The routine shown will execute with every play of the game. It may be modified e.g. to vary the event that is guaranteed on each reset.

Instead of the gaming apparatus being an EGM, it may take any other suitable form, and could for example comprise a game provided on a computing or other electronic device, such as on a personal computer, PDA, mobile phone, digital television, or the like. The game may be provided over an intranet, the Internet, or some other communications system, such as a mobile telephone system.

The game played may take any suitable form. It could be e.g. a slot machine type game, poker, keno, bingo, pachinko, blackjack, roulette or any other suitable game.

The guarantee indicator 9 could be a gauge, e.g. including a pointer on a scale. The indicator need not be displayed on the screen 5, and could be displayed separately or form a physical gauge or the like.

The guarantee indicator need not always relate to the same game event, and could change to the monitoring of a different game event e.g. depending on the state of play.

After a player has finished a playing session, the guarantee may be reset, or may continue on for the next player, or may be stored in a player's history, so that the guarantee will resume from its previous status when the player returns to the game.

It is to be understood that various alterations, additions and/or modifications may be made to the parts previously described without departing from the ambit of the present invention, and that, in the light of the above teachings, the present invention may be implemented in software, firmware and/or hardware in a variety of manners as would be understood by a person skilled in the art.

What is claimed is:

1. A gaming system including:

a component for monitoring gameplay;

a component for monitoring the occurrence of a game event;

an event guarantee component for triggering a guaranteed game event if the monitored game event has not triggered within a set amount of gameplay; and a guarantee indicator component for providing a guarantee indicator that indicates during gameplay the amount of gameplay that must occur before the guaranteed event is triggered wherein the guarantee indicator changes during game play.

2. The system of claim 1, wherein the system includes a central control for running a gaming algorithm, and a plurality of remote clients in communication with the central control over a communications network, the remote clients including screens for displaying gaming screens and inputs for allowing player interaction with the central control, guarantee indicators being provided on the client screens.

3. A method of operating gaming apparatus, the method comprising the steps of:

executing software located on a computer-readable medium with said gaming apparatus;

monitoring gameplay with said gaming apparatus;

monitoring the occurrence of a game event on said gaming apparatus;

triggering a guaranteed event if the monitored event does not occur within a set amount of gameplay; and indicating during gameplay with said gaming apparatus the amount of gameplay remaining before a guaranteed event is triggered and thereafter indicating a different amount of game play remaining before a guaranteed event is triggered.

4. Gaming apparatus comprising:

a gameplay monitor for monitoring user interactions with the apparatus;

an event monitor for monitoring the occurrence of a game event; and a guarantee feature for triggering a gaming event if the monitored event has not occurred within a set amount of gameplay and for indicating to a user at different times during gameplay the amount of gameplay remaining before the guarantee feature is triggered.

5. Gaming apparatus including:

a component for monitoring gameplay;

a component for monitoring the occurrence of a game event; and an event guarantee component for guaranteeing that a game event will trigger within a set amount of gameplay, the event guarantee component including: a trigger component for triggering a game event when the set guarantee gameplay amount is reached without the monitored event having been triggered, and an indicator component for indicating during gameplay the amount of gameplay remaining to be played before a guaranteed game event will trigger and for indicating a changed amount of gameplay remaining to be played before a guaranteed game event will trigger.

6. The apparatus of claim 5, wherein gameplay is measured based on the number of plays of a game, and/or on the amount bet on a game.

7. The apparatus of claim 5, wherein the monitored event and the guaranteed game event are the same event.

8. The apparatus of claim 5, wherein the monitored event and/or guaranteed event is a prize win.

9. The apparatus of claim 8, wherein the prize win is a win of a certain value or a win based on a particular set of circumstances.

10. The apparatus of claim 5, wherein the monitored event and/or guaranteed event is a feature event.

11. The apparatus of claim 10, wherein the feature event is the appearance of one or more particular symbols.

12. The apparatus of claim 10, wherein the feature event is the appearance of a wild feature.

13. The apparatus of claim 10, wherein the feature event is one of an extraneous game from a main game, a bonus game, a free play, a respin, or a high payout game.

14. The apparatus of claim 5, wherein the monitored event is an event from a set of monitored events.

15. The apparatus of claim 5, wherein the guaranteed event is an event from a set of possible guarantee events.

16. The apparatus of claim 5, wherein the monitored event is normally triggered randomly.

17. The apparatus of claim 5, wherein the monitored event is normally triggered based on a particular set of game circumstances.

18. The apparatus of claim 5, wherein the event guarantee component includes a reset component for resetting the guarantee gameplay amount if the monitored event is triggered before the guarantee gameplay amount is reached.

19. The apparatus of claim 5, wherein the event guarantee component includes a reset component for resetting the guaranteed event or events to a different event or events when a guaranteed event is triggered and/or when a monitored event is triggered normally.

20. The apparatus of claim 5, wherein the indicator component displays the type of event that will be triggered by the guarantee component.

21. The apparatus of claim 5, wherein the indicator component displays a numerical countdown of the remaining guarantee gameplay amount.

22. The apparatus of claim 5, wherein the indicator component displays a gauge having a scale on which the remaining guarantee gameplay amount is indicated.

23. The apparatus of claim 5, wherein the indicator component displays play parameters that will apply when a guaranteed event is triggered.

24. The apparatus of claim 5, wherein play parameters for the guaranteed event are determined from play parameters existing during normal play.

25. The apparatus of claim 5, wherein play parameters for the guaranteed event are determined from an average of play parameters existing during normal play.

26. The apparatus of claim 5, wherein play parameters for the guaranteed event are determined randomly.

27. The apparatus of claim 5, wherein the guarantee gameplay amount that must be played before the guaranteed event is triggered is determined randomly.

28. The apparatus of claim 5, wherein the guarantee gameplay amount that must be played before the guaranteed event is triggered is set to a predetermined value.

29. The apparatus of claim 5, wherein two or more game events are separately guaranteed, and wherein the indicator means provides two or more indicators, one for each guaranteed event.

30. The apparatus of claim 5, wherein the game run by the gaming apparatus is from the group of a slot-machine game, poker, keno, bingo, blackjack, roulette, or pachinko.

31. The apparatus of claim 5, wherein the apparatus is an electronic gaming machine.

32. The apparatus of claim 5, wherein the apparatus includes a central control and a plurality of remote devices in communication with the central control.

33. The apparatus of claim 5, wherein the apparatus includes a network of electronic devices.

34. The apparatus of claim 32, wherein the guarantee gameplay amount is based on combined gameplay for a plurality of said devices.

35. Gaming software including:

a component for monitoring gameplay;

a component for monitoring the occurrence of a game event; and an event guarantee component for guaranteeing that a game event will trigger within a set amount of gameplay, the event guarantee component including:

a trigger component for triggering a game event when the set guarantee gameplay amount is reached without the monitored event having been triggered, and an indicator component for indicating during gameplay the amount of gameplay remaining to be played before a guaranteed game event will trigger and for changing an indication of the amount of gameplay remaining to be played before a guaranteed game event will trigger.

36. A gaming software product, including a recording media on which the software of claim 35 is recorded.

37. Gaming apparatus including:

means for monitoring gameplay;

means for monitoring the occurrence of a game event; and event guarantee means for guaranteeing that a game event will trigger within a set amount of gameplay, the event guarantee means including:

a trigger component for triggering a game event when the set guarantee gameplay amount is reached without the monitored event having been triggered, and an indicator means for indicating the amount of gameplay remaining to be played before a guaranteed game event will trigger.

* * * * *

UNITED STATES PATENT AND TRADEMARK OFFICE

CERTIFICATE OF CORRECTION

PATENT NO. : 8,465,361 B2
APPLICATION NO. : 11/406468
DATED : June 18, 2013
INVENTOR(S) : Benjamin James Ellis It is certified that error appears in the above-identified patent and that said Letters Patent is hereby corrected as shown below:

On the Title Page, add:

Related U.S. Application Data

(63) Continuation of application No. PCT/AU2004/001402 filed October 13, 2004

Signed and Sealed this
Nineteenth Day of November, 2013

Teresa Stanek Rea

Teresa Stanek Rea
*Deputy Director of the United States Patent and Trademark Office*